US009161647B2

(12) United States Patent
Leung

(10) Patent No.: US 9,161,647 B2
(45) Date of Patent: Oct. 20, 2015

(54) STAND WITH INSERTS

(71) Applicant: Polygroup Macau Limited (BVI), Tortola (VG)

(72) Inventor: Chi Yin Alan Leung, Kowloon Bay (HK)

(73) Assignee: POLYGROUP MACAU LIMITED (BVI), Tortola (VG)

( * ) Notice: Subject to any disclaimer, the term of this patent is extended or adjusted under 35 U.S.C. 154(b) by 0 days.

(21) Appl. No.: 14/206,046

(22) Filed: Mar. 12, 2014

(65) Prior Publication Data

US 2014/0291472 A1 Oct. 2, 2014

Related U.S. Application Data

(60) Provisional application No. 61/805,604, filed on Mar. 27, 2013.

(51) Int. Cl.
*F16M 11/38* (2006.01)
*A47G 33/12* (2006.01)

(52) U.S. Cl.
CPC ..... *A47G 33/1206* (2013.01); *A47G 33/12* (2013.01)

(58) Field of Classification Search
USPC ..... 248/688, 27.8, 127, 146, 150, 370, 248/163.1, 165, 166, 167, 172, 440.1, 248/188.1, 188.6, 188.7, 188.8, 346.04, 248/519, 528, 527, 159, 314, 511, 512, 514, 248/518, 523, 525, 529, 533, 534, 535, 248/539; 47/40.5, 42; 403/361
See application file for complete search history.

(56) References Cited

U.S. PATENT DOCUMENTS

| | | | | | |
|---|---|---|---|---|---|
| 2,292,505 | A | * | 8/1942 | Black | 248/524 |
| 2,706,609 | A | * | 4/1955 | Sullivan | 248/167 |
| 2,980,377 | A | * | 4/1961 | Nielsen et al. | 248/523 |
| 3,338,605 | A | * | 8/1967 | Stoeber | 403/174 |
| 3,648,957 | A | * | 3/1972 | Bencriscutto | 248/544 |
| 3,664,617 | A | * | 5/1972 | Fenwick | 248/539 |
| 3,679,528 | A | * | 7/1972 | Spiegel | 428/7 |
| 3,908,943 | A | * | 9/1975 | Bannister | 248/159 |
| 4,941,635 | A | * | 7/1990 | Lan | 248/346.11 |
| 5,022,620 | A | * | 6/1991 | Scott | 248/188.6 |
| 5,236,167 | A | * | 8/1993 | Tai et al. | 248/529 |
| 5,326,064 | A | * | 7/1994 | Sapien | 248/311.2 |
| 5,484,131 | A | * | 1/1996 | Aldrete et al. | 248/527 |
| 5,869,151 | A | * | 2/1999 | Chong | 428/18 |
| RE36,640 | E | * | 4/2000 | Frost et al. | 248/528 |
| 6,094,859 | A | * | 8/2000 | Kalman et al. | 47/40.5 |
| 6,138,977 | A | * | 10/2000 | Tsai | 248/523 |
| 6,293,512 | B1 | * | 9/2001 | Ho | 248/579 |

(Continued)

*Primary Examiner* — Terrell McKinnon
*Assistant Examiner* — Michael McDuffie
(74) *Attorney, Agent, or Firm* — Troutman Sanders LLP; Ryan A. Schneider; Benjamin C. Wiles

(57) ABSTRACT

A system for mounting decorative objects, such as Christmas trees, is disclosed. The system can include a base and a plurality of inserts. The base can comprise a plurality of feet that have a retracted position for ready storage and a deployed position for supporting a tree. The base can further comprise a locking mechanism for locking the feet in the retracted position, the deployed position, or both. The base can further comprise an adapter for receiving one or more inserts. The inserts can comprise a consistent outer diameter, for insertion into the adapter, and a variety of inner diameters for use with a variety of tree diameters. The insert can be installed on the trunk of a tree and then installed into the adapter on the base simplifying the tree erection process.

19 Claims, 6 Drawing Sheets

(56) References Cited

U.S. PATENT DOCUMENTS 6,688,565 B1 * 2/2004 Chen ..... 248/166
7,364,130 B2 * 4/2008 Lai ..... 248/519
8,215,603 B2 * 7/2012 Puleo ..... 248/528
8,298,633 B1 * 10/2012 Chen ..... 428/20
2011/0073737 A1 * 3/2011 Lin ..... 248/346.03
2012/0009360 A1 * 1/2012 Fu et al. ..... 428/8

* cited by examiner

STAND WITH INSERTS

CROSS-REFERENCE TO RELATED APPLICATION AND PRIORITY CLAIM

This application claims the benefit, under 35 U.S.C. §119 (e), of U.S. Provisional Patent Application No. 61/805,604, filed 27 Mar. 2013, entitled "STAND WITH ADAPTERS," the entire contents and substance of which is incorporated herein by reference in its entirety as if fully set forth below.

BACKGROUND OF THE INVENTION

1. Field of the Invention

Embodiments of the present invention relate generally to stands, and more specifically to Christmas tree stands with locking legs and/or inserts.

2. Background of Related Art

Stands exist for Christmas trees and other decorations. Conventional tree stands, for example, generally comprise some sort of base and a support means for the trunk of the tree. In many conventional designs, as shown in FIGS. 1*a* and 1*b*, the legs 120 of the stand 100 can be disposed about a common axis and can be disposed on separate, rotatably coupled collars 125*a*, 125*b*. The interlocking collars 125 enable the legs 120 of the stand 100 to be rotated from a retracted position (FIG. 1*a*) to a deployed position (FIG. 1*b*). In the retracted position, the legs 120 are substantially parallel enabling the stand 100 to be easily stored. In the deployed position, on the other hand, the legs 120 can be substantially perpendicular to each other to provide improved support and stability for a tree or other object (hereinafter, "tree").

Conventionally, in some known designs, set screws 105 are used to both lock the base 110 of the stand 100 in the deployed position and to secure the tree to the stand 100. As shown, this configuration can cause several problems. One problem is the stand 100 is not locked into either the deployed position or the retracted position until after the tree is placed into and secured in the stand 100. In other words, because the set screws 105 have not yet been extended, the legs 120 can move back and forth between the retracted and deployed positions, possibly causing impact or pinching related injuries, for example. This complicates the already difficult task of inserting and stabilizing the tree until the tree stand 100 can be attached and locked in place.

In addition, to adequately support larger trees, for example, the set screws 105 must be screwed substantially into the base of the tree until they partially penetrate the trunk. This not only requires a great deal of hand strength, but damages the tree, living or artificial. For a live tree, this damage can, in turn, lead to, for example and not limitation, fungal infections, poor circulation, and other indirect damage, accelerating the deterioration of the tree, among other problems. For an artificial tree, this damage may result in the tree needing to be replaced annually or after a limited number of uses.

What is needed, therefore, is a tree stand with separate locking and supporting means. It should be able to support commonly sized trees without penetrating, or otherwise damaging, the tree. It is to such a system that embodiments of the present invention are primarily directed.

BRIEF SUMMARY OF THE INVENTION

Embodiments of the present invention relate generally to stands, and more specifically to Christmas tree stands with locking legs and/or trunk inserts. In some embodiments, the stand can comprise two or more concentric cylinders and two or more support legs. In some embodiments, the concentric cylinders can be rotatable about a common axis to enable the support legs to move from a retracted position to a deployed position. The concentric cylinders can comprise a locking mechanism to prevent the rotation of the cylinders when desired. In some embodiments, the locking mechanism can lock the concentric cylinders in the retracted position, the deployed position, or many position therebetween.

In some embodiments, the Christmas tree stand can have a plurality of legs, a central cylindrical base portion having a center axis, a receiver portion, comprising a top face perpendicular to the center axis, and a removable insert. According to the present disclosure, the removable insert may include a lower end, an upper end in contact with the top face, and a plurality of tree retention devices disposed on an inner surface of the insert and configured to frictionally engage an outer surface of a Christmas tree. In some embodiments, the receiver portion also includes at least one slot extending parallel to the center axis, and the removable insert includes at least one tab on the insert configured to engage the at least one slot in the receiver portion.

In some embodiments, the removable insert can have a plurality of ribs disposed on the lower end of the insert, extending radially away from the center axis. Further, the plurality of tree retention devices can be a plurality of ridges extending inward from the inner surface of the removable insert. In some embodiments, the receiver portion has a central recess having a receiver diameter, and the lower end of the removable insert can have an outer diameter that corresponds to the receiver diameter. The Christmas tree stand can also include a second removable insert with a second outer diameter substantially equal to the outer diameter of the removable insert, and a second inner diameter different from that of the removable insert.

Other embodiments according to the present disclosure can have an outer base, an inner base, a locking mechanism, and an insert. The outer base can have an upper cylindrical portion, a lower cylindrical portion, and a first plurality of legs attached to both the upper and lower cylindrical portions. The inner base can have an inner cylindrical portion and a second plurality of legs attached to the inner cylindrical portion between the upper cylindrical portion and the lower cylindrical portion. Some embodiments also have a locking mechanism configured to fix the position of the outer base with respect to the inner base. According to the present disclosure, the insert can be in communication with the upper cylindrical portion, and have a cylindrical central void and a locating feature configured to secure the insert with respect to the upper cylindrical portion.

In some embodiments, the locking mechanism can be configured to fix the position of the outer base with respect to the inner base in two or more different positions. These positions can include one position in which the first and second pluralities of legs are equally spaced apart from one another, and a different position in which the first and second pluralities of legs are in contact with each other. By way of example, the locking mechanism can be a set screw that selectively engages the inner and outer bases, or a detent that is connected to the lower cylindrical portion of the inner base.

In accordance with the present disclosure, the support device can have a plurality of ridges protruding from the insert into the cylindrical central void. Additionally, the upper cylindrical portion have one or more slots, and the locating feature can consist of one or more tabs extending radially and engaging one or more of the slots. In some embodiments, the insert can have a plurality of ribs located on the insert, and extending radially towards the inner base.

Some methods of supporting a Christmas tree, according to the present disclosure, include the step of providing a Christmas tree stand having a plurality of legs, a central cylindrical base portion having a center axis, and a receiver portion including a top face perpendicular to the center axis, wherein the receiver portion has a central recess having a receiver diameter. A method can also include manufacturing a plurality of inserts, with each having an upper end, a lower end, an inner diameter, and a plurality of tree retention devices, wherein an outer diameter of the lower end corresponds to the receiver diameter. Some methods can include the step of providing at least one insert of the plurality of inserts with the Christmas tree stand wherein the insert is configured to be inserted into the receiver portion. The receiver portion can also include at least one slot extending parallel to the center axis, with the at least one insert including at least one tab configured to engage the at least one slot in the receiver portion. According to the present disclosure, manufacturing the plurality of inserts can include making at least two inserts having different inner diameters.

These and other objects, features and advantages of the present invention will become more apparent upon reading the following specification in conjunction with the accompanying drawing figures.

DETAILED DESCRIPTION OF THE INVENTION

Figure 1A:
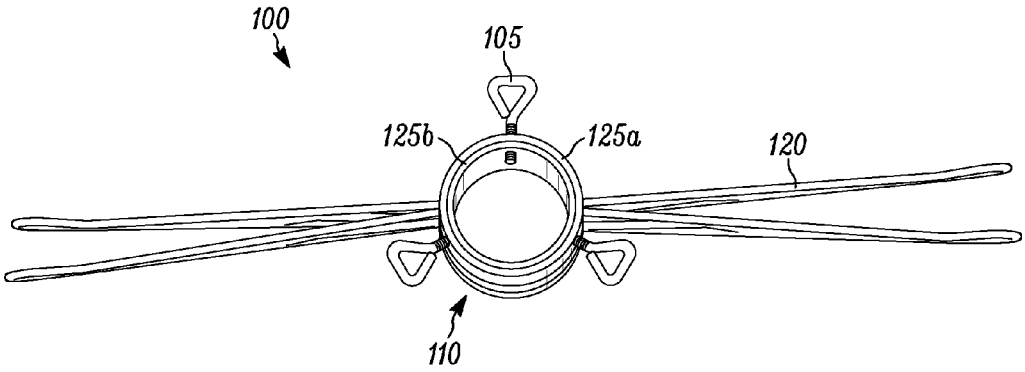
Fig. 1a Prior Art
FIGS. 1*a* and 1*b* depict a conventional tree stand in the retracted and deployed positions, respectively.
Figure 1B:
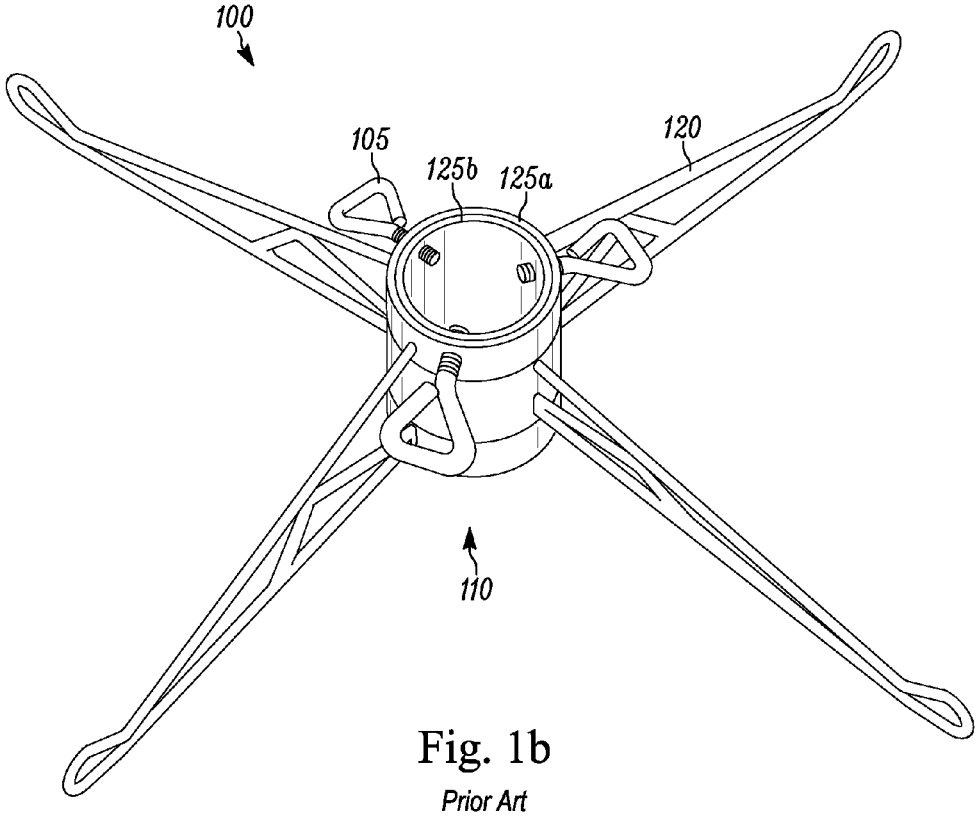
Fig. 1b Prior Art
Figure 1C:
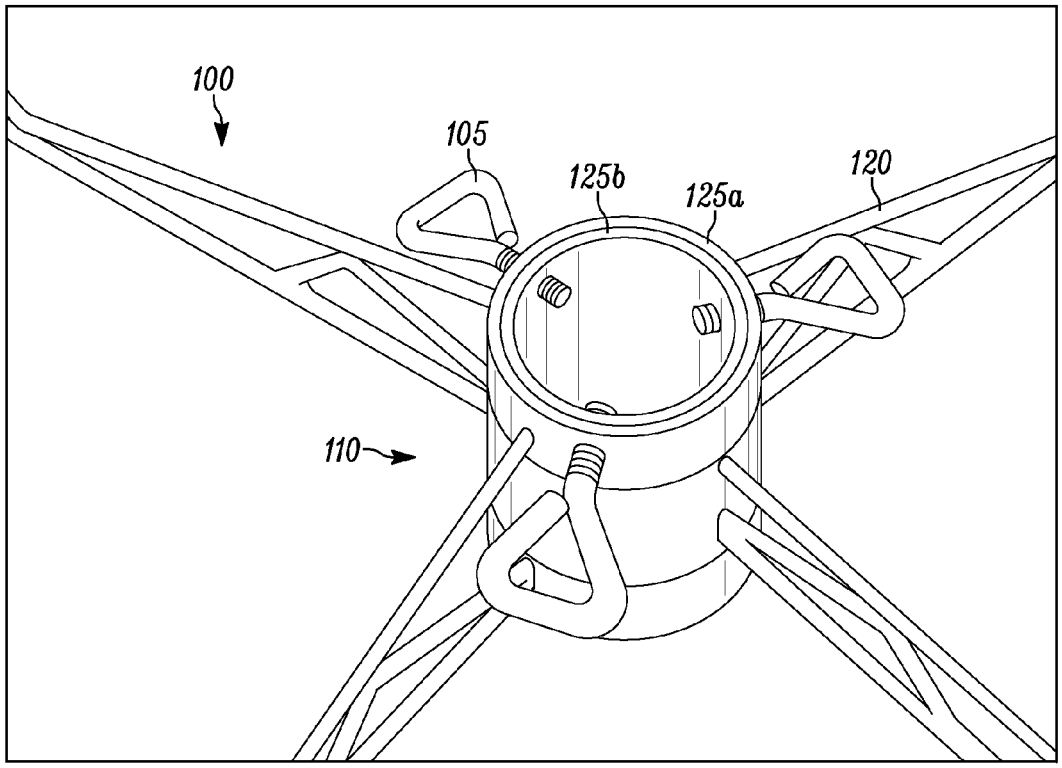
Fig. 1c Prior Art
FIG. 1*c* is a detailed view of FIG. 1*b*.

Embodiments of the present invention relate generally to stands, and more specifically to Christmas tree stands with locking legs and/or trunk adapters. The system can comprise a base, an adapter, and a plurality of inserts. The base can comprise a plurality of folding legs for supporting the tree in the deployed position, while folding for convenient storage and/or transportation. The base can comprise a locking mechanism to lock the legs in the deployed position, the retracted position, or in many positions between the two. The base can comprise an adapter for receiving a plurality of inserts. The system can further comprise a plurality of inserts with a common outer diameter and varying inner diameters. In this configuration, the inserts can enable trees with varying trunk diameters to be mounted in the base. In some embodiments, the inserts can mount directly to the base, foregoing the use of an adapter.

To simplify and clarify explanation, the system is described below as a system for supporting artificial Christmas trees. One skilled in the art will recognize, however, that the invention is not so limited. The system can also be deployed, for example and not limitation, to support living trees and other ornamental objects in many situations. The system can also be deployed to support many objects that require support in a substantially vertical manner such as, for example, ornamental trees, and flag poles.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

As mentioned above, a problem with conventional tree stands has been that they are both difficult to deploy and damage the tree they are intended to support. In addition, different stands can be required for different sized Christmas trees. Conventional stands can be difficult to deploy, for example, because there are no mechanisms in place to prevent the support legs from swinging back and forth while the stand is being placed on the tree (or vice-versa), for example. As a result, the legs can cause impact and/or pinching injuries to the user, for example, and generally add to the complexity and instability of the process. When attempting to control an already unwieldy Christmas tree, the conventional stand adds an unwelcome element of difficulty.

In addition, for some known stand designs to provide sufficient clamping force or support for many trees, the stand's set screws have to be screwed in until they at least partially dent the trunk of the tree. This requires either a person with uncommonly strong hands or, at minimum, additional tools to create sufficient force to turn the set screws. In addition, this configuration damages the tree's trunk. This damage can necessitate the replacement of the tree, among other problems.

As shown in FIGS. 2*a*-3*b*, embodiments of the present invention relate to a stand 200 with an integral locking mechanism 205. In some embodiments, the stand 200 can comprise two or more concentric cylinders 210*a*, 210*b* rotatably coupled. In some embodiments, cylinder 210*b* can comprise an outer base having an upper and lower cylindrical portion, and cylinder 210*a* can comprise an inner base. The stand 200 can further comprise three or more supports 215, or legs, coupled to one or more of the cylinders 210. The rotatable cylinders 210 can enable the legs 215 to be rotated from a first, retracted position (FIG. 2*a*) to a second, deployed position (FIG. 2*b*). In the first position, the legs 215 coupled to cylinder 210*a* contact the legs 215 coupled to cylinder 210*b*. In some embodiments, the stand 200 can further comprise an adapter 217 for receiving one or more inserts 220, as discussed below. Adapter 217 can be inserted into an upper portion of stand 200, and may have a flanged top portion with a central opening coaxial to cylinders 210. Adapter 217 may fit over one of the cylinders 210, or it may fit inside of one of the cylinders 210. The functions of adapter 217 may be performed by a receiver portion, which may be an adapter 217, or a region formed by a portion of stand 200, such as of one of the cylinders 210. In some embodiments, the base 202 of the stand 200 can comprise, for example and not limitation, metal or plastic.

Figure 2A:
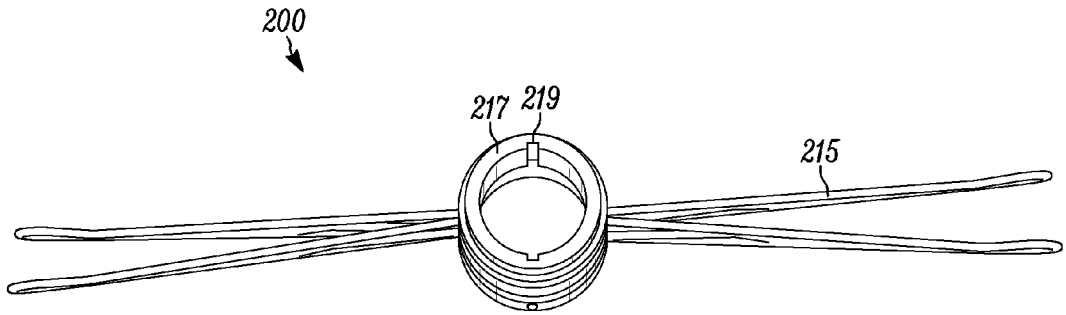
FIGS. 2*a* and 2*b* depict a tree stand with an adapter in the retracted and deployed positions, respectively, in accordance with some embodiments of the present invention.
Figure 2B:
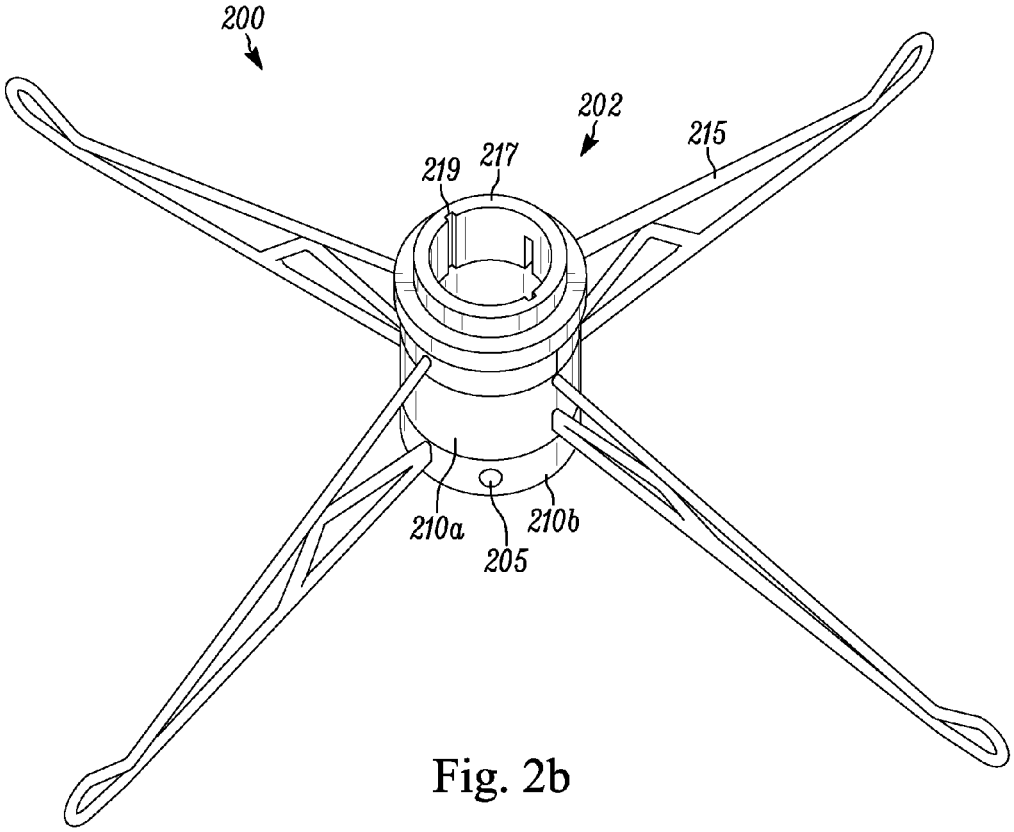
Figure 2C:
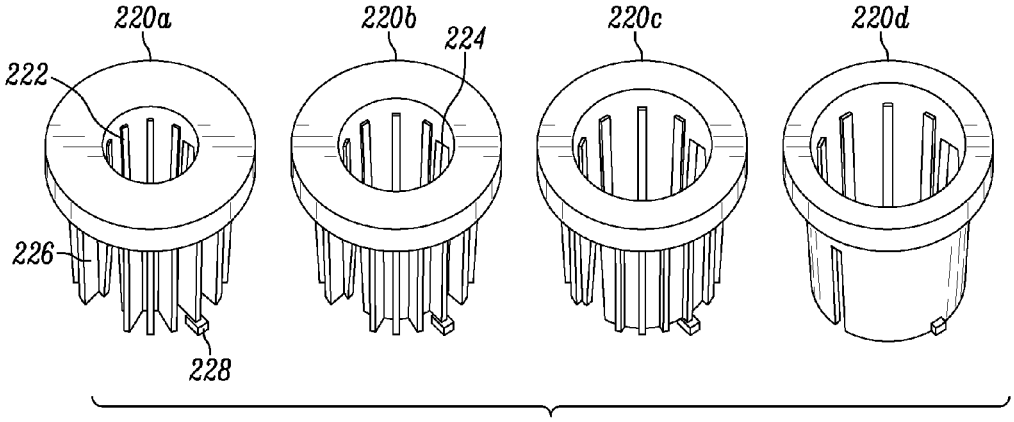
FIG. 2*c* depicts a plurality of inserts with different inner diameters for insertion into the adapter, in accordance with some embodiments of the present invention.
Figure 2D:
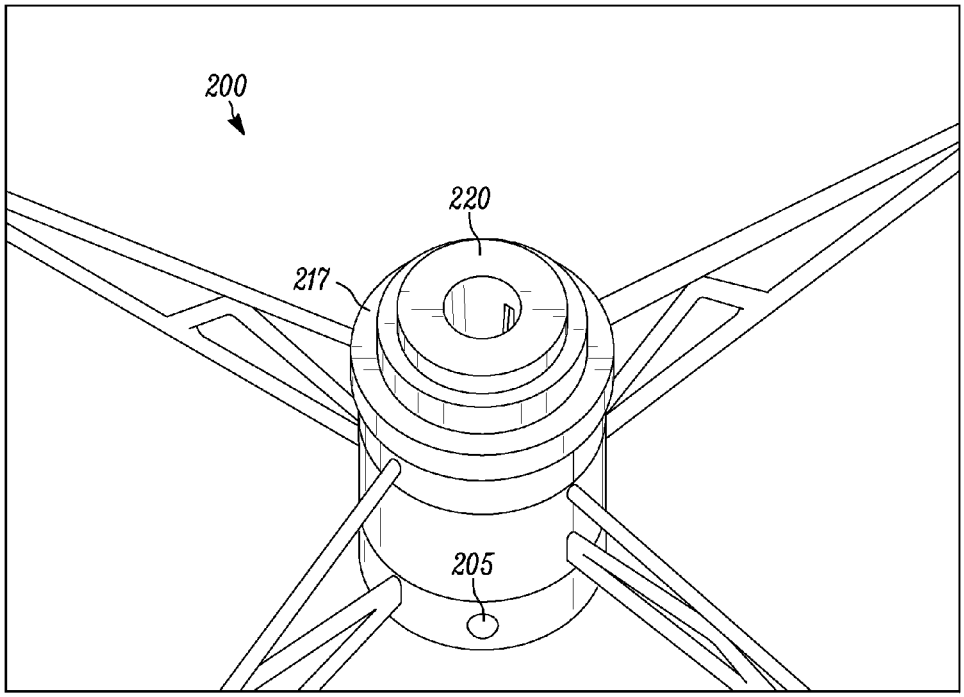
FIG. 2*d* depicts one of the inserts from FIG. 2*c* inserted into an adapter in a tree stand, in accordance with some embodiments of the present invention.

As shown in FIGS. 2*c* and 2*d*, the system 200 can further comprise a plurality of inserts 220. The inserts 220*a-d* can comprise a plurality of collars with a common outer diameter, but varying inner diameters. In this manner, an insert 220 can be chosen with an appropriate inner diameter to retain a tree with a particular trunk diameter, for example, while providing the correct diameter to interface with the adapter 217 in the stand 200. As a result, the user can choose the appropriate insert 220 for a particular tree, slide the insert over the tree trunk, and then place the insert 220 in the adapter 217 in the stand 200.

In some embodiments, the inserts 220 can comprise ridges 222 that enable the tree trunk to slide easily into the insert 220, but prevent the tree trunk from being easily removed from the insert 220. In some embodiments, barbs, fingers, or other means to retain the tree trunk in the adapter can be used. In some embodiments, the inserts 220 can comprise a one-way cam, or other means, that requires the user to press a release to remove the insert 220 from the tree trunk.

In some embodiments, the inserts 220 can be frictionally engaged in the adapter 217. In some embodiments, the inserts 220 can comprise one or more relief cuts 224 to enable the insert 220 to flex slightly when inserted into the adapter 217. In this manner, compression can be created between the inserts 220 and the adapter 217 for frictional retention. In some embodiments, ribs 226 are included on insert 220 to control the maximum amount of flex by contacting an inner surface of adapter 217 before the insert 220 flexes more than a desired amount. Ribs 226 can prevent insert 220 from cracking or breaking under stress. In other embodiments, the inserts 220 can be slightly conical and can match a similarly conical surface in on the interior of the adapter 217.

In some embodiments, locating features, such as tabs 228, can be included on inserts 220 in order to secure insert 220 into adapter 217. Insert 220 can be in contact with an upper face of adapter 217. To maintain contact between insert 220 and adapter 217, locating features can take many forms. For example, tabs 228 can protrude from a lower portion of insert 220. Adapter 217 may include slots 219 which can receive tabs 228. In some embodiments, once tabs 228 pass through slots 219, rotating insert 220 serves to secure insert 220 in adapter 217. In still other embodiments, adapter 217 and inserts 220 can be engaged with, for example and not limitation, tongue and groove joints, set screws, or pins. The inserts 220 and adapter 217 can comprise, for example and not limitation, plastic, metal, or ceramic materials that are suitable for casting, molding, machining, or otherwise manufacturing into suitable shapes.

The system 200 can further comprise a locking mechanism 205. The locking mechanism 205 can enable the cylinders 210 to be locked into the first position, the second position, or other positions therebetween. In this manner, the legs 215 can be locked in a stable position when the user is attempting to insert the tree into the stand 200, for example, or attempting to attach the stand 200 to the tree. As shown in FIG. 3*a*, in some embodiments, the locking mechanism 205 can comprise one or more set screws 305 to frictionally engage the cylinders 210. Set screws 305 can selectively engage both cylinders 210*a* and 210*b*.

Figure 3B:
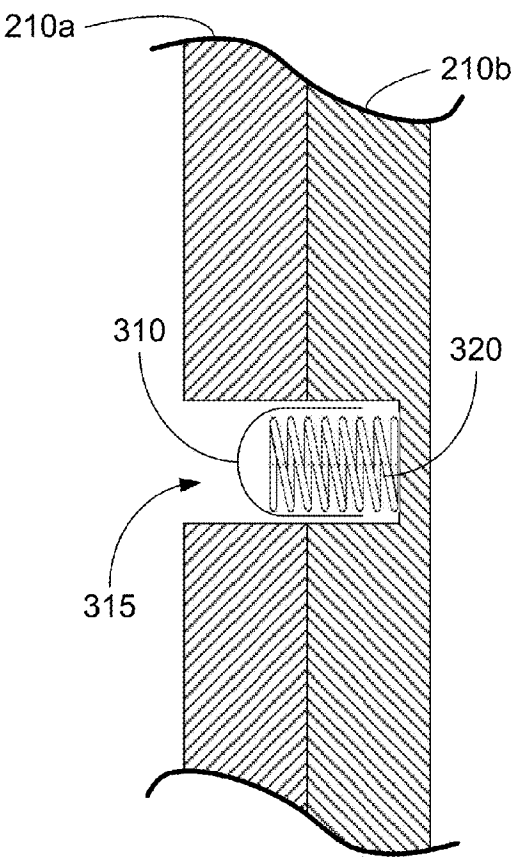
FIG. 3*b* depicts a spring-loaded detent locking mechanism, in accordance with some embodiments of the present invention.
Figure 3A:
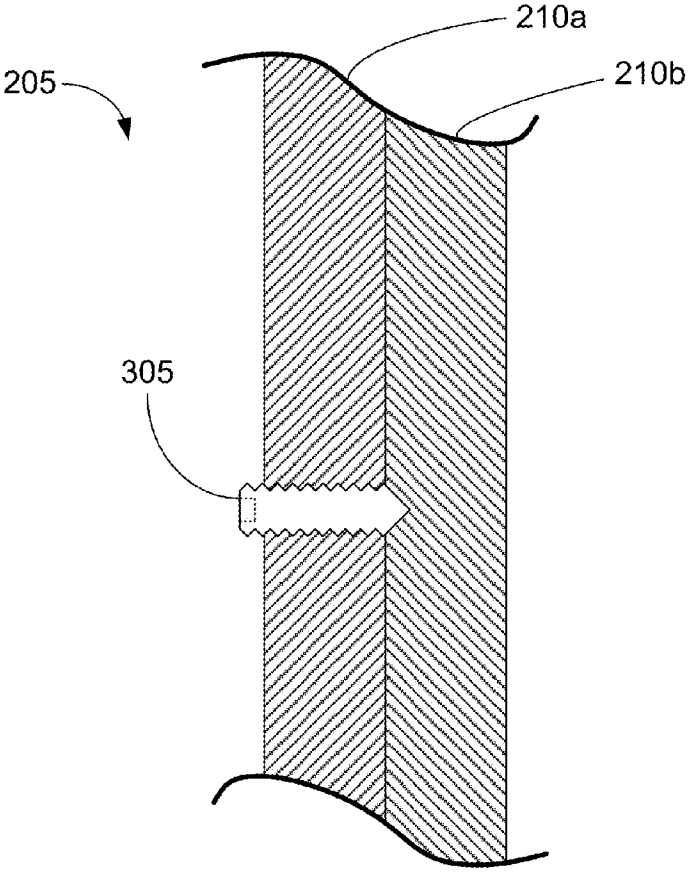
FIG. 3*a* depicts a set screw locking mechanism, in accordance with some embodiments of the present invention.

In other embodiments, as shown in FIG. 3*b*, the locking mechanism 205 can comprise a spring loaded detent 310. In this configuration, when a hole 315 in one of the cylinders 210 aligns with the detent 310, the detent 310 can protrude through the hole 315 preventing rotation of the cylinder 210. The detent 310 can be mounted over a spring 320, or other device, to provide the force necessary to retain the detent 310 in the hole 315. To release this type of locking mechanism 205, the user can simply depress the detent 310. In some embodiments, detent 310 is connected to a spring 320 that is anchored to an inner surface of cylinder 210*a*. In some embodiments there is a plurality of holes 315 in one of the cylinders in order to allow the detent to engage cylinder 210*b* in multiple locations. The locking mechanism 205 could also comprise, for example and not limitation, a bolt, pin, e-clip, or snap ring.

Figure 4A:
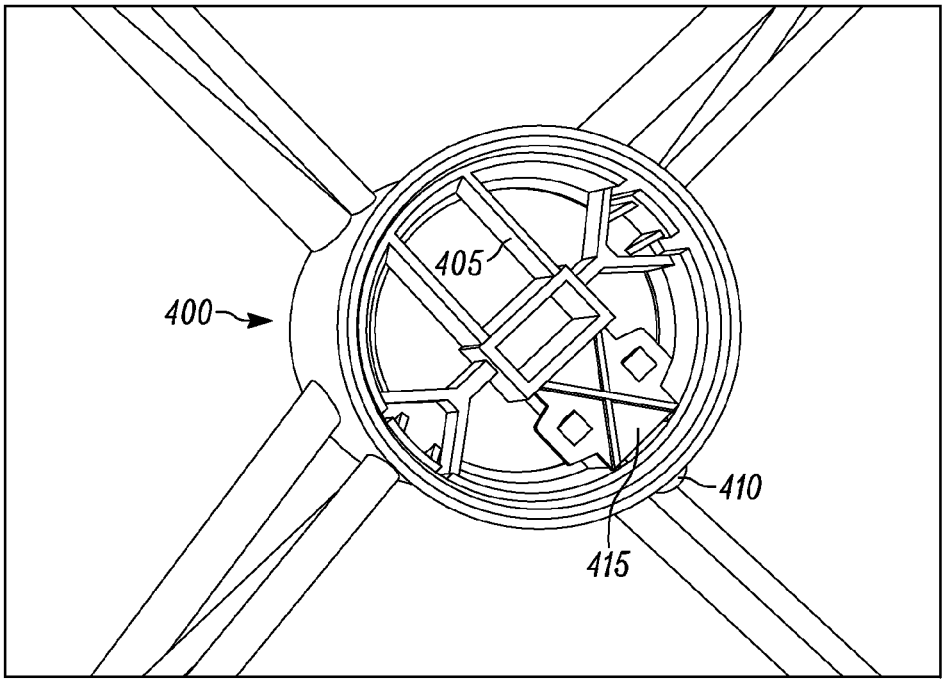
FIG. 4*a* depicts an alternative spring-loaded detent locking mechanism, in accordance with some embodiments of the present invention.
Figure 4B:
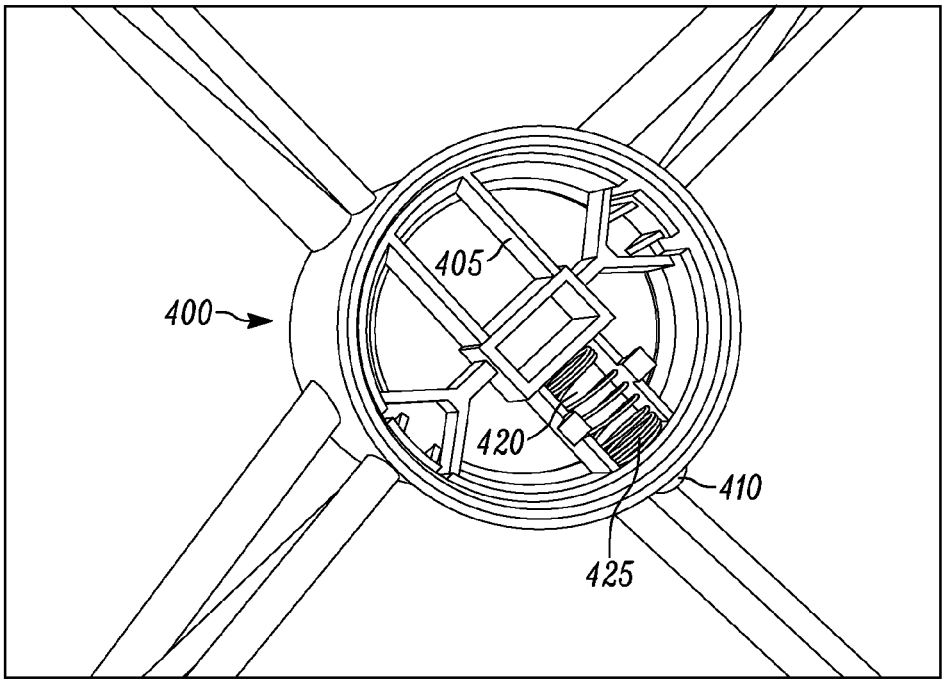
FIG. 4*b* depicts the alternative spring-loaded detent locking mechanism of FIG. 4*a* with the spring cover removed.

In FIG. 4*a*, an alternative locking mechanism 400 is illustrated. Bracket 405 can be used to support detent 410. In some embodiments, spring cover 415 can be employed to cover spring cavity 420 and protect spring 425 from being disloged or broken. FIG. 4*b* shows how, in some embodiments, spring 420 biases detent 410 to provide locking to the cylinders. Spring 425 can be anchored against bracket 405 in spring cavity 420, and can provide sufficient force to urge detent 410 into a locked position when desired, but also allow a user to push detent 410 out of the hole for opening or closing the stand.

A method for supporting a Christmas tree can include employing a tree stand in accordance with the above disclosure. Inserts may be manufactured in many different shapes and sizes in order to mate with different tree trunks. The stand could be shipped and/or sold with a plurality of inserts as a 'universal' tree stand. Alternatively, the stand could be packaged with different artificial trees and a single insert. This method could allow for a single type of stand to be manufactured, and inserts could allow it to support an entire product line of different trees.

While several possible embodiments are disclosed above, embodiments of the present invention are not so limited. For instance, while several possible uses for the stand, including supporting a variety of decorative trees, have been disclosed, other uses are possible and are contemplated herein. In addition, the location and configuration used for various features of embodiments of the present invention can be varied according to, for example and not limitation, a particular tree size, mounting location, or tree material that requires a slight variation due to, for example, the materials used and/or space constraints. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A Christmas tree stand, comprising:

a plurality of legs;

a central cylindrical base portion having a center axis;

a receiver portion, comprising a top face perpendicular to the center axis;

a first removable insert adapted for a first Christmas tree having a first outer diameter and a first inner diameter and comprising:

a first lower end;

a first upper end adapted to contact the top face; and a first plurality of tree retention devices disposed on an inner surface of the first insert and configured to frictionally engage an outer surface of the first Christmas tree; and a second removable insert adapted for a second Christmas tree, the second removable insert having a second outer diameter and a second inner diameter, wherein the second outer diameter is substantially equal to the first outer diameter and the second inner diameter is not equal to the first inner diameter and comprising:

a second lower end;

a second upper end adapted to contact the top face; and a second plurality of tree retention devices disposed on an inner surface of the second insert and configured to frictionally engage an outer surface of a second Christmas tree.

2. The Christmas tree stand of claim 1, wherein the receiver portion further comprises at least one slot extending parallel to the center axis.

3. The Christmas tree stand of claim 2, wherein the first removable insert further comprises at least one tab on the insert configured to engage the at least one slot in the receiver portion.

4. The Christmas tree stand of claim 1, wherein the first removable insert further comprises a plurality of ribs disposed on the lower end of the insert, extending radially away from the center axis.

5. The Christmas tree stand of claim 1, wherein the first plurality of tree retention devices comprise a plurality of ridges extending inward from the inner surface of the first removable insert.

6. The Christmas tree stand of claim 1, wherein the receiver portion has a central recess having a receiver diameter.

7. The Christmas tree stand of claim 6, wherein the first lower end of the first removable insert has an outer diameter that corresponds to the receiver diameter.

8. A support device, comprising:

an outer base comprising:

an upper cylindrical portion;

a lower cylindrical portion; and a first plurality of legs attached to both the upper and lower cylindrical portions;

an inner base comprising:

an inner cylindrical portion; and a second plurality of legs attached to the inner cylindrical portion between the upper cylindrical portion and the lower cylindrical portion;

a locking mechanism configured to fix the position of the outer base with respect to the inner base; and a plurality of interchangeable inserts configured for communication with the upper cylindrical portion, each comprising:

a cylindrical central void having a diameter, wherein the diameter of the cylindrical central void of two or more of the plurality of interchangeable inserts is different;

an outer diameter, wherein the outer diameter of two or more of the plurality of interchangeable inserts is substantially equal; and a locating feature configured to secure the insert with respect to the upper cylindrical portion.

9. The support device of claim 8, wherein the locking mechanism is configured to fix the position of the outer base with respect to the inner base in two or more different positions.

10. The support device of claim 9, wherein the two or more different positions comprise one position in which the first and second pluralities of legs are equally spaced apart from one another, and a different position in which the first and second pluralities of legs are in contact with each other.

11. The support device of claim 8, wherein the locking mechanism comprises a set screw that selectively engages the inner and outer bases.

12. The support device of claim 8, wherein the locking mechanism comprises a detent that is connected to the lower cylindrical portion of the inner base.

13. The support device of claim 8, further comprising a plurality of ridges protruding from the insert into the cylindrical central void.

14. The support device of claim 8, wherein the upper cylindrical portion further comprises one or more slots.

15. The support device of claim 14, wherein the locating feature comprises one or more tabs extending radially and engaging one or more of the slots.

16. The support device of claim 8, wherein the insert further comprises a plurality of ribs located on the insert, and extending radially towards the inner base.

17. A method comprising:

providing a Christmas tree stand comprising:

a plurality of legs;

a central cylindrical base portion having a center axis; and a receiver portion, comprising a top face perpendicular to the center axis, wherein the receiver portion has a central recess having a receiver diameter;

manufacturing a plurality of inserts, each having an upper end, a lower end, an inner diameter, and a plurality of tree retention devices, wherein an outer diameter of the lower end corresponds to the receiver diameter; and providing at least one insert of the plurality of inserts with the Christmas tree stand;

wherein two or more inserts of the plurality of inserts have different inner diameters and substantially equal outer diameters, and wherein the plurality of inserts are configured to be inserted into the receiver portion.

18. The method of claim 17, wherein the receiver portion further comprises at least one slot extending parallel to the center axis, and wherein the at least one insert further comprises at least one tab configured to engage the at least one slot in the receiver portion.

19. The Christmas stand of claim 1, further comprising a third removable insert having a third outer diameter and a third inner diameter, wherein the third outer diameter is substantially equal to the first and second outer diameters and the third inner diameter is not equal to the first or second inner diameters.

* * * * *